US006722547B1

(12) United States Patent
Wang et al.

(10) Patent No.: US 6,722,547 B1
(45) Date of Patent: Apr. 20, 2004

(54) METHOD AND APPARATUS FOR CONTROLLING ELECTRONIC NAIL GUN

(75) Inventors: Guan-He Wang, Tali (TW); Michael Spur Lock, Tali (TW)

(73) Assignee: Nailermate Enterprise Corp., Tali (TW)

( * ) Notice: Subject to any disclaimer, the term of this patent is extended or adjusted under 35 U.S.C. 154(b) by 0 days.

(21) Appl. No.: 10/394,611

(22) Filed: Mar. 21, 2003

(51) Int. Cl.[7] ..... B25C 1/04

(52) U.S. Cl. ..... 227/8; 227/130; 227/131; 227/156; 173/170

(58) Field of Search ..... 227/8, 130, 131, 227/156, 2; 173/170, 1

(56) References Cited

U.S. PATENT DOCUMENTS 3,796,365 A * 3/1974 Downing ..... 227/8
3,930,604 A * 1/1976 Pitkin et al. ..... 227/8
4,284,223 A * 8/1981 Salcido et al. ..... 227/5
4,346,831 A * 8/1982 Haytayan ..... 227/8
5,509,489 A * 4/1996 Lower, Jr. ..... 173/170
5,522,532 A * 6/1996 Chen ..... 227/8
6,079,605 A * 6/2000 Braun et al. ..... 227/130
6,199,739 B1 * 3/2001 Mukoyama et al. ..... 227/8

* cited by examiner

*Primary Examiner*—Scott A. Smith
(74) *Attorney, Agent, or Firm*—Charles E. Baxley

(57) ABSTRACT

The present invention discloses a method and an apparatus for controlling an electronic nail gun, comprising a trigger link rod and a trigger. If a user triggers a fine-tune switch, the controller will control a three-outlet pneumatic valve to switch the three-outlet airflow according to the shooting mode set by the user, so that the valve rod of a cylinder will generate a predetermined number of times of the back and forth movements in a predetermined time to drive the trigger link rod, and the trigger will be pulled for a predetermined number of times in a predetermined time.

20 Claims, 6 Drawing Sheets

METHOD AND APPARATUS FOR CONTROLLING ELECTRONIC NAIL GUN

BACKGROUND OF THE INVENTION

1. Field of the Invention

The present invention relates to a nail gain, more particularly to a method and apparatus for controlling the triggering of an electronic nail gun.

2. Description of the Related Art

The general structure and function of a nail gun is briefly introduced as follows. A nail gun comprises a gun body, said gun body has a gun handle and a gun head; a cylinder disposed in said gun head; a high-pressure gas pipe coupled to one end of said gun handle, and a high-pressure gas being input and introduced into said cylinder; a piston disposed in the cylinder, said piston connected to a nail shooting mechanism at the external end of said gun head, and said nail shooting mechanism coupled to a nail magazine; a safety device disposed at the external end of said gun head of said gun body, preventing the nail gun from being triggered under unsafe conditions. When the safety device is pressed down, the gun body can be triggered under a safe condition, and the piston is pushed outward by the gas pressure such that the nail shooting mechanism can shoot out the nail at the nailing position.

SUMMARY OF THE INVENTION

The primary objective of the present invention is to change the way of controlling a nail gun into manual control or electronic control, and the user can switch the control to either manual control or electronic control. In electronic control mode, the shooting mode and speed can be adjusted. Users may choose the appropriate mode as required to finish their nailing job.

The technical measures taken by this invention to solve the problem as listed below. A controlling device of an electronic nail gun built on the body of a traditional nail gun, comprises:

- a controller for a user to set a shooting mode;
- a power supply for supplying electric power to said controller;
- a three-outlet pneumatic valve for controlling the movement according to the shooting mode set by said controller;
- a cylinder having a valve rod, said valve rod moving back and forth and controlled by an airflow direction set by said three-outlet pneumatic valve;
- a fine-tune switch being pressed and controlled by a user to turn on said three-outlet pneumatic valve; and
- a trigger link rod, having one end coupled to the valve rod of said cylinder, and the other end producing a clutch relationship with the trigger of the nail gun; thereby the trigger of the nail gun being indirectly controlled by the valve rod of said cylinder when the trigger link rod being engaged with the trigger.

DETAILED DESCRIPTION OF THE PREFERRED EMBODIMENTS

Figure 1:
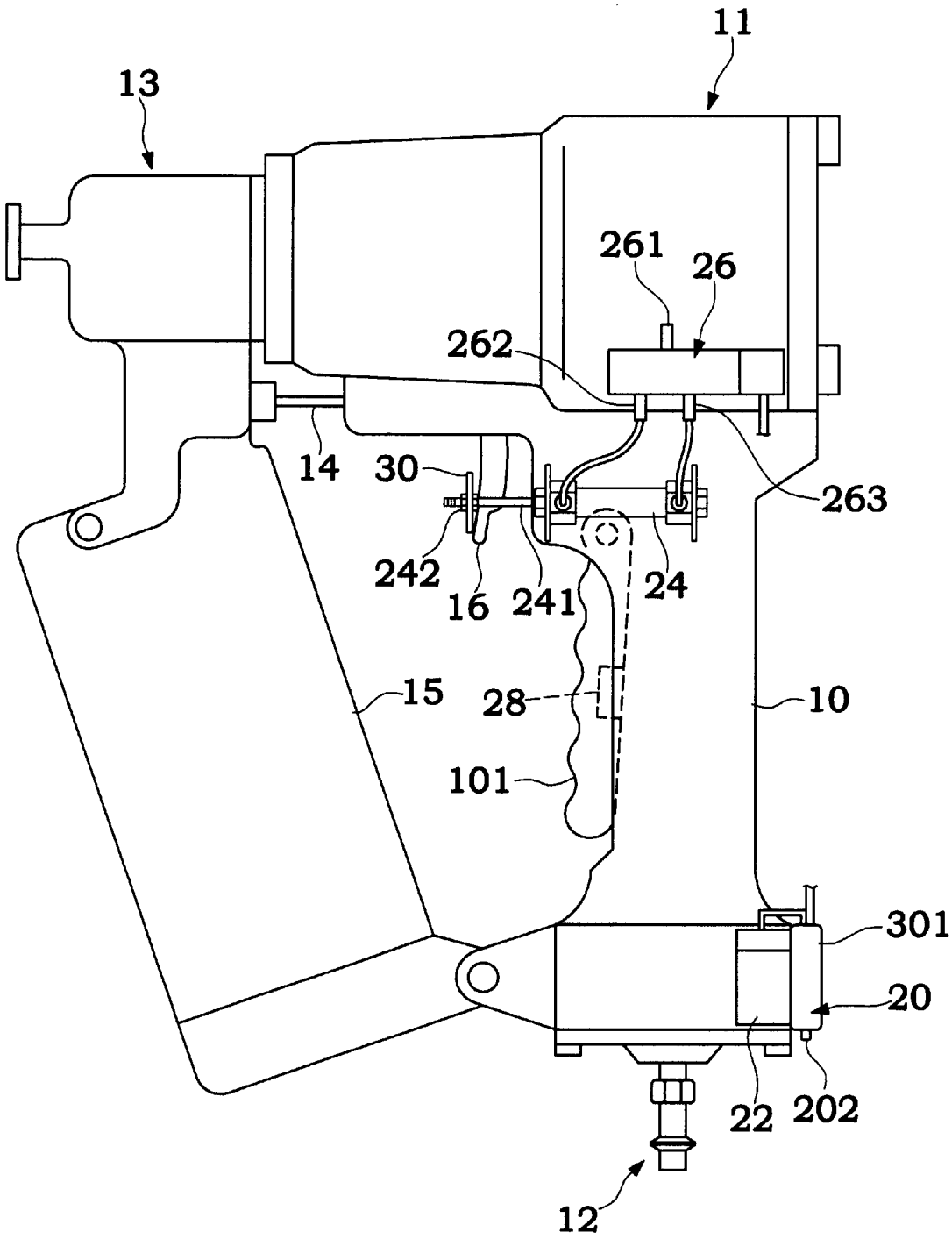
FIG. 1 is an illustrative diagram of the electronic controlling device being built into the body of the nail gun according to the present invention.
Figure 2A:
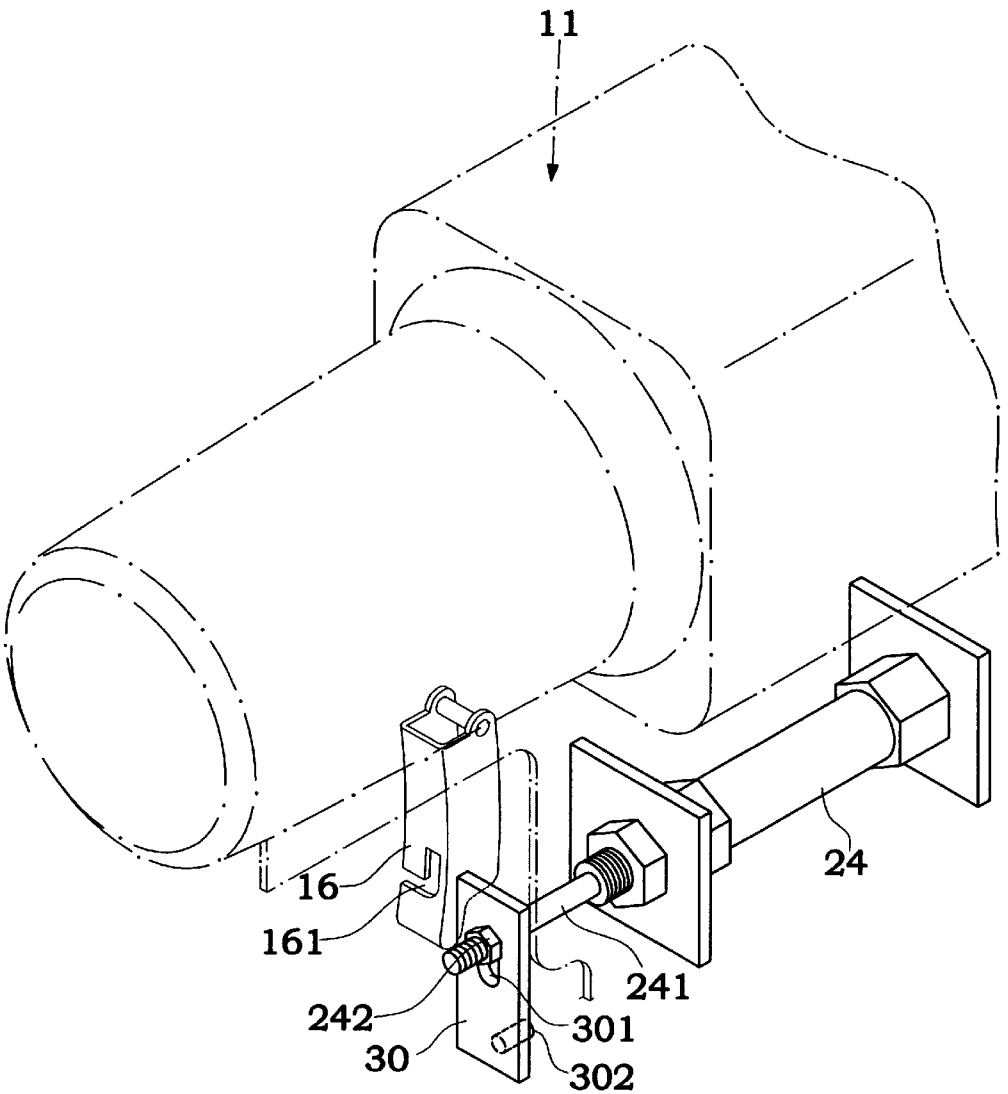
FIG. 2A is an illustrative diagram of the connection of cylinder valve rod, trigger link rod, and trigger according to the present invention.
Figure 2B:
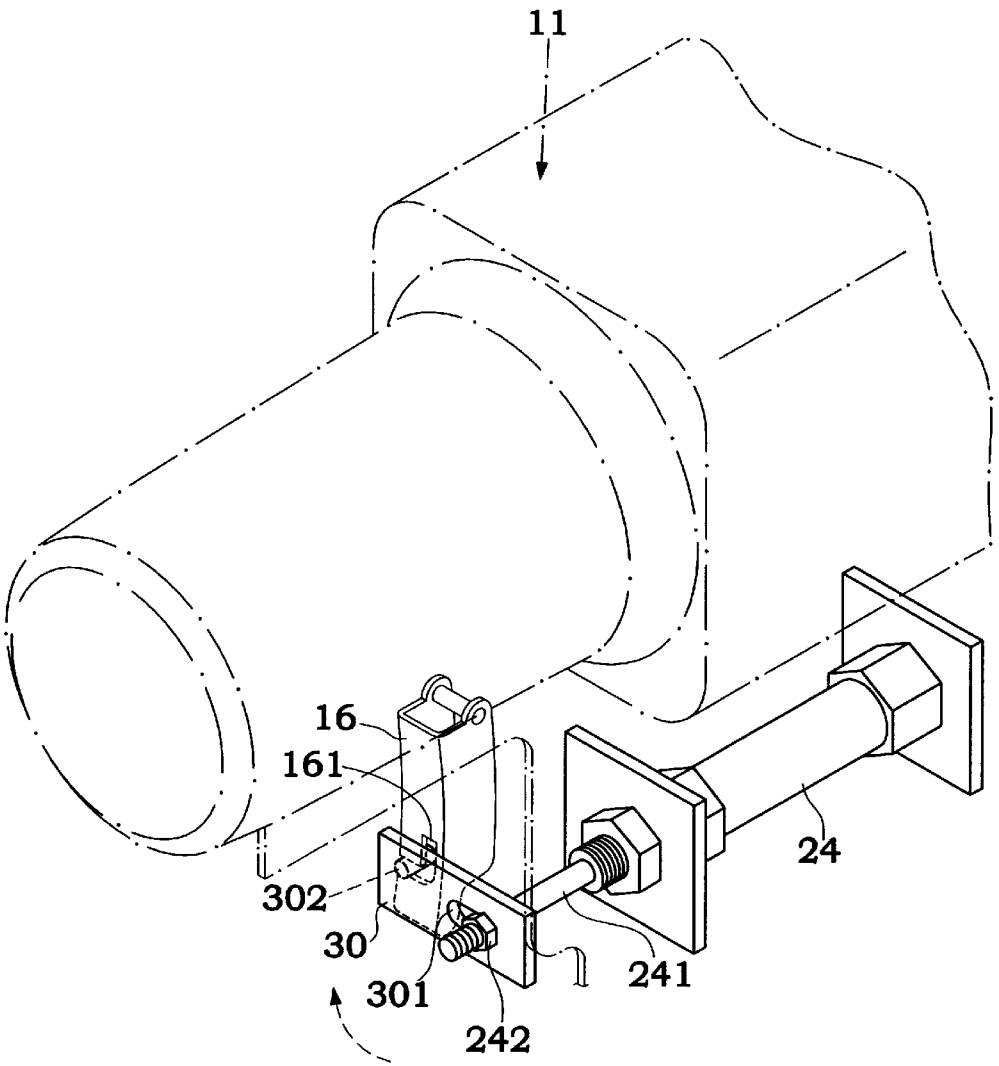
FIG. 2B is another illustrative diagram of the connection of cylinder valve rod, trigger link rod, and trigger according to the present invention.
Figure 2C:
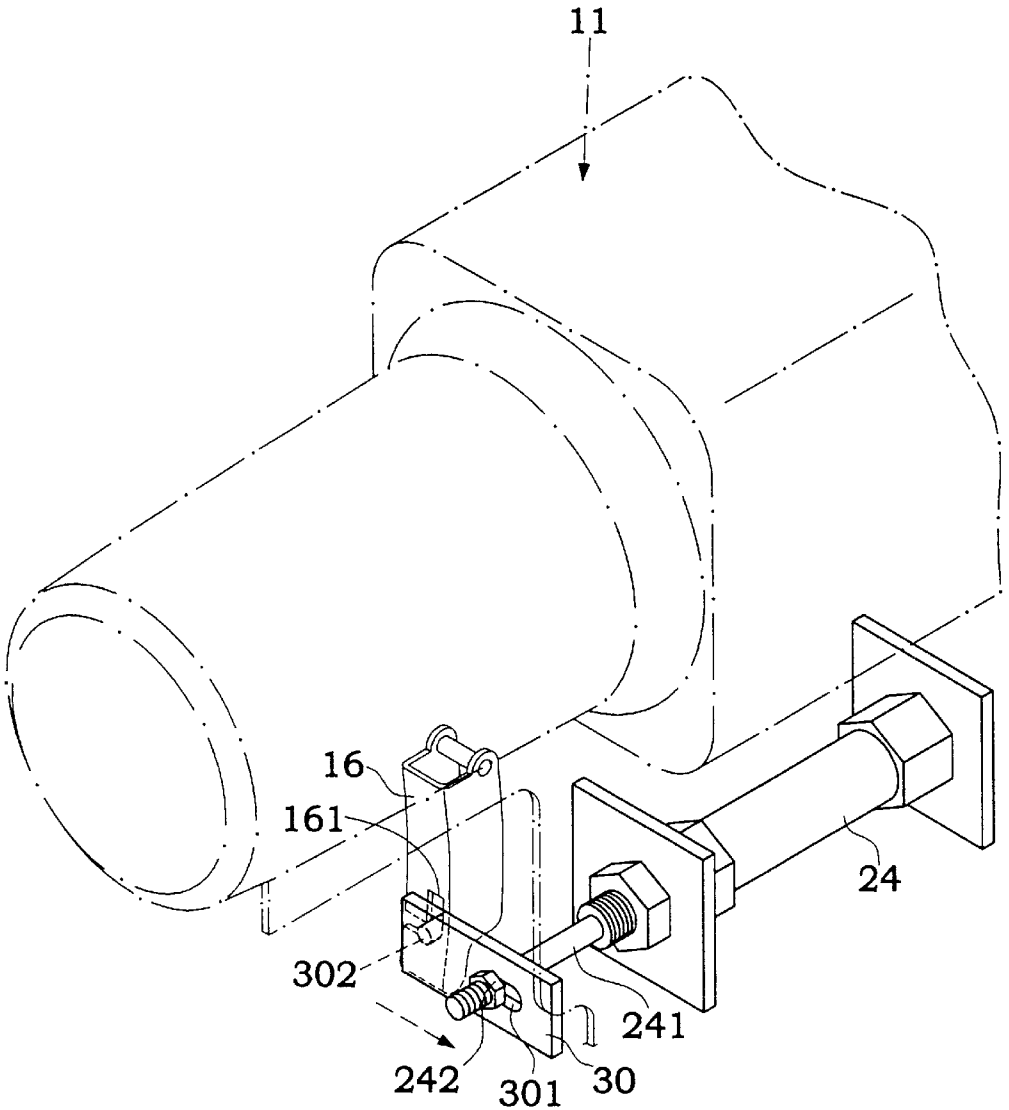
FIG. 2C is a further illustrative diagram of the connection of cylinder valve rod, trigger link rod, and trigger according to the present invention.

The electronic control method and apparatus according to the present invention are built in the body of a traditional nail gun. The body of a traditional nail gun adopted by this embodiment (as shown in FIG. 1) comprises a gun handle 10, a gun head 11, a high-pressure pneumatic pipe connector 12, a nail shooting mechanism 13, a safety link rod 14 of a safety device, a nail magazine 15, and a trigger 16. The mechanical shooting movement of the nail gun is the same as that of a related prior art.

Please refer to FIG. 1 for the electronic controlling device of this invention, comprising:

- a controller 20, disposed on one side of the end of a gun handle 10, for letting a user set a shooting mode for the nail gun; the controller 20 having a displaying screen and two press buttons 202, and the displaying screen being used for showing the set mode, and the press button for selecting and setting the mode; the shooting mode will be described in details in the following section;
- a power supply 22, being a battery (adopted by this embodiment) for supplying electric power to said controller 20;
- a cylinder 24 disposed on one side of a gun head 11 proximate a trigger 16;
- a three-outlet pneumatic valve 26 for controlling the movement according to the shooting mode set by said controller; said three-outlet pneumatic valve in this embodiment being disposed on the outer side of the gun head 11, having a connector 261 connected to a cylinder in the gun head (not shown in the diagram), and two connectors 262, 263 respectively connected to the front and rear ends of the cylinder 24; the three-outlet pneumatic valve 26 utilizing a small quantity of gas in the cylinder of the nail gun; the power supply 22 supplies electric power to an electromagnetic switch in the three-outlet pneumatic valve 26 to switch the gas flow direction of the three outlets, and further driving the valve rod 241 to produce a back and forth movement;
- a fine-tune switch 28, producing a startup control signal to a controller 30 to control the startup of said three-outlet pneumatic valve 26, and said fine-tune switch 28 in this embodiment being disposed on a movable handle rod 101 at the inner side of the gun handle 10 for letting the user to hold the handle while pressing said movable handle rod 101 to trigger the fine-tune switch 28;
- a trigger link rod 30 as shown in FIGS. 1, 2A, 2B, and 2C, having one end coupled to a valve rod 241 of the cylinder 24, and the other end producing a clutch relationship with the trigger 16; thereby the trigger of the nail gun being indirectly controlled by the valve rod of said cylinder when the trigger link rod being engaged with the trigger; the trigger link rod 30 in this embodiment having a long hole 301 at an end coupled to the valve rod for letting the threaded section at one end of the valve rod 241 pass through, and fixed by two screw nuts 242, and the two nuts 242 being tightly secured so that the trigger link rod 30 being fixed on the valve rod 241; on the contrary, the two nuts 242 being loosened to loose the trigger link rod 30 and positioned at one end of the valve rod for the user's control for its movement. The trigger link rod 20 has a protruded latch 302 disposed at position in a direction facing the trigger 16, and the protruded latch 302 can be latched into a L-shape hole on the trigger 16, such that when the user shifts the trigger link rod 30 to a position separated from the trigger 16, the trigger link rod 30 and the trigger 16 no longer have the linking relationship. Then, the user has to pull the trigger 16 to control the shooting of nails from the nail gun. On the other hand, if the user shifts the trigger link rod 30 to the opening of the L-shape hole 161 corresponsive to the protruded latch 302, then the trigger link rod 30 attaches to a fixed position in front of the trigger 16 constituting a linking relation with the trigger 16. In order words, if the trigger link rod 30 is driven by valve rod 241 of the cylinder 24 to move back and forth, it will produce a repeated action of pulling the trigger 16.

Figure 3:
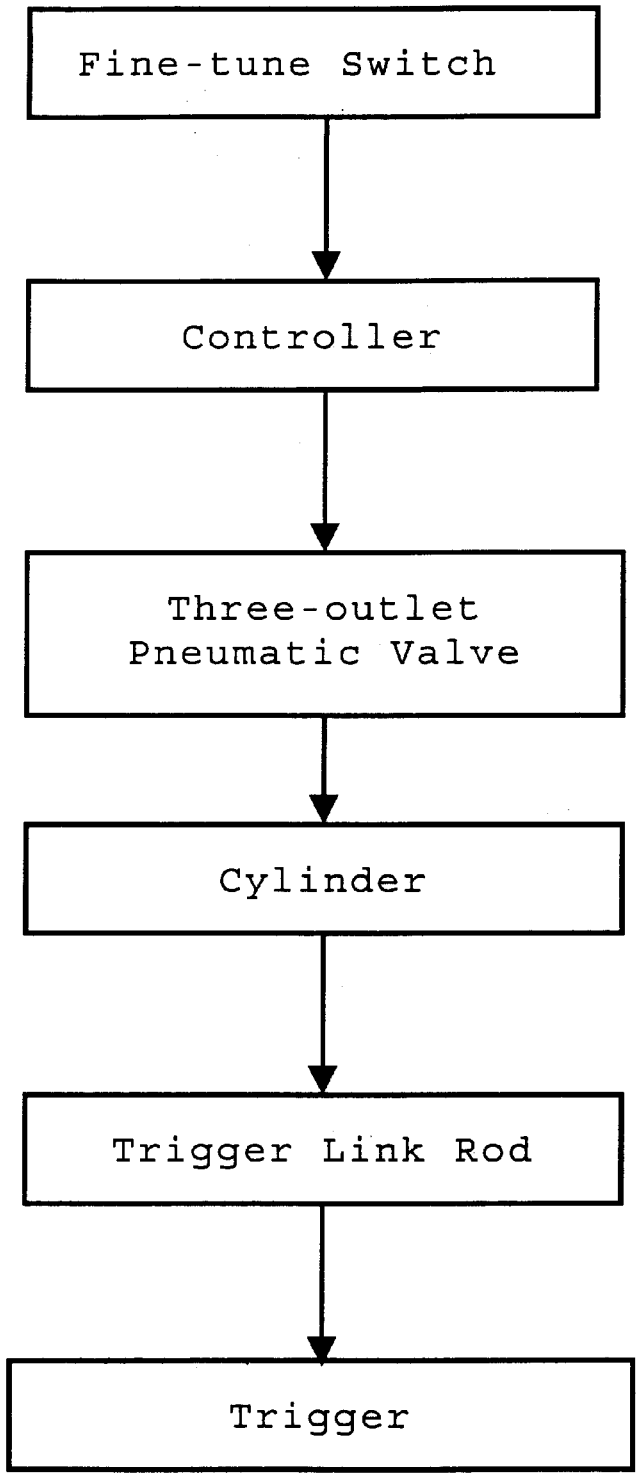
FIG. 3 is a flow chart of the control of the present invention.

In FIG. 3, the above device separates the trigger link rod 30 and the trigger 16; the electronic control device is off; and the nail gun is manually controlled for a single shot or successive shots as described in the prior art. If the trigger link rod 30 and the trigger 16 have the linking relationship and the electronic controlling device is on, the trigger 16 of the nail gun is controlled by the electronic controlling device; in other words, the user presses the movable handle rod 101 to trigger the fine-tune switch 28, and then the controller 20 will follow the user's set shooting mode to control the three-outlet pneumatic valve 26 to switch the thee outlets of the air flow, such that the valve rod 241 of the cylinder 24 produces a predetermined number of times of the back and forth movements in a predetermined time to drive the trigger link rod 30, so that the trigger 16 also triggers a predetermined number of times in a predetermined time. Therefore, the nail gun shots according to the shooting mode.

The electronic control method of this invention is described as follows, said method comprising the steps of:

(a) setting a shooting mode;

(b) letting a back-and-forth mechanism move back and forth according to the set shooting mode; and (c) letting a trigger of said nail gun trigger synchronously with said back and forth movement.

The controller 20 described in this method enables a user to set the shooting mode. The back-and-forth mechanism comprises a three-outlet pneumatic valve 26, a cylinder 24, and a valve rod 241. The back-and-forth mechanism is controlled by the controller 20; the trigger 16 of the nail gun is coupled by said trigger link rod 30 and said back-and-forth mechanism to generate the synchronous movement. The above method also comprises a switch for the user's control (which is the aforementioned fine-tune switch 28 to generate a shooting signal and drive the back-and-forth mechanism to start moving or stopping.

Figure 4:
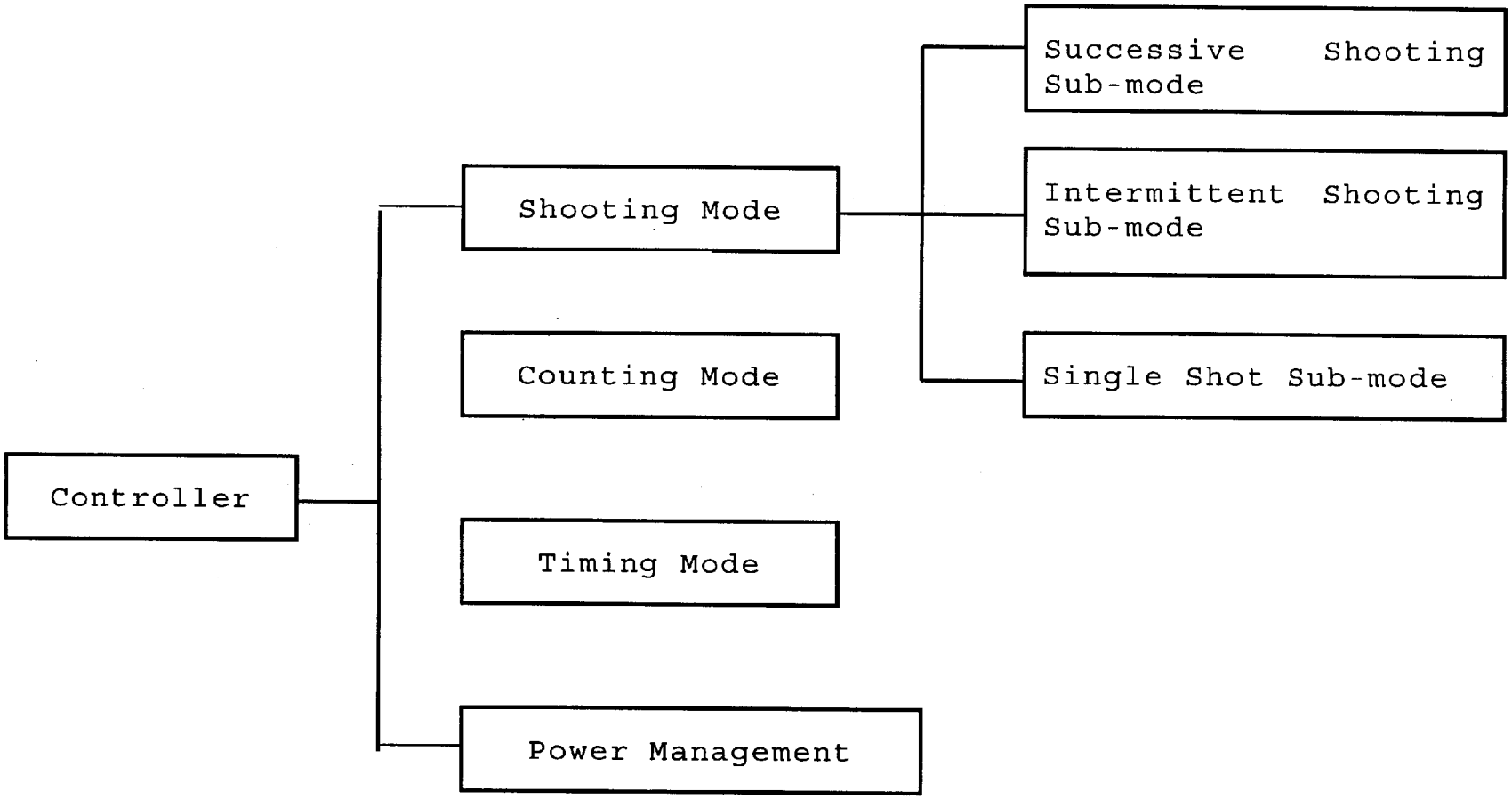
FIG. 4 is a functional block diagram of the controller according to the present invention.

The control options of the controller 20 of the present invention and the shooting mode are described as follows. In FIG. 4, the controller 20 provides four main modes: shooting mode, counting mode, timing mode, and power management mode. The counting mode counts the number of nails shot from the nail gun. The timing mode counts the time of using the nail gun or the extended time initialized by the electronic control device. The power management mode disconnects the power if the nail gun has not been used for a predetermined time.

The shooting mode can be set for a single shot mode or a successive shooting mode. The so-called single shot means that if the user pulls the movable handle rod 101 once, the fine-tune switch 28 is triggered once, and the fine-tune switch 28 generates a shooting signal to the controller 20, and the controller 20 control the valve rod 241 of the cylinder 24 to produce one time of the back and forth movement. The trigger link rod 30 drives the trigger 16 to produce one pull and shoot out one nail. The so-called successive shooting mode means that if the user pulls the movable handle rod 101 once or continues pulling the movable handle rod 101, such that the fine-tune switch 28 generates a shooting signal or successive shooting signals to the controller 20 and the controller 20 follows the shooting speed (4~20 shots per minute) to control the cylinder valve rod 241 to produced the number of successive back and forth movements. The trigger link rod 30 is used for pulling the trigger 16 for successive times, and the number of nails will be shot accordingly. Regardless the single shot mode or the successive shooting mode, the nail can be shot only when the safety device of the nail gun is pressed.

The method of operating and setting the controller is described as follows:

As described above, the controller 20 has an appearance showing a screen display and two pushbuttons 202, and we called those pushbuttons as F-1 key and F-2 key, The F-1 key can toggle between the four main modes of the controller 20, and that is the screen display will show the shooting mode, counting mode, timing mode, or power saving management mode in sequence. Press F-2 key to show the mode that the user wants to set, and enable the user to set such desired mode. For example, when the screen shows "Shooting Mode", press F-2 key can set the shooting mode.

The shooting mode of this invention includes at least 3 more sub-modes for user's setup. Pressing the F-2 key can toggle between the three sub-modes. Until the desired sub-mode is reached, press the F-1 key to enter such sub-mode for the setup. If the sub-mode still has further option, use the F-2 key for the toggle, and F-1 key for the setup. After the setup is completed, follow the instruction to return to the upper level of sub-modes or options. The three sub-modes of this embodiment are successive shooting sub-mode, intermittent shooting sub-mode, single shot sub-mode.

The successive shooting sub-mode can set up the shooting speed, and the maximum shooting speed is about 4~20 shots per minute. Users may continuously press the movable handle rod 101 and continuously press the fine-tune switch 28, such that the fine-tune switch 28 continues issuing the shooting message, and the controller 20 follows the predetermined shooting speed (4~20 shots per minute) to control the cylinder valve rod 241 to produce the successive times of back and forth movements. The trigger link rod 30 is used to successively pull the trigger 16 for several times and shoot the nail at a predetermined speed.

The intermittent shooting sub-mode is set up according to the set shooting speed; when the fine-tune switch 28 issues a shooting message for shooting a number of nails. Assumed that the set number of nails is 10, the user presses the movable handle rod 101 once, and press the fine-tune switch 28 once, such that the fine-tune switch 28 issues a shooting message, and the controller 20 immediately controls the cylinder valve rod 241 to produce 10 times of the back and forth movements according to the aforementioned shooting speed. The trigger link rod 30 is used to pull the trigger 16 ten times and shoot out 10 nails according to the predetermined speed.

The single shot sub-mode indicates that when the fine-tune switch 28 issues a shooting message for shooting a nail. In other words, when the user pulls the movable handle rod 101 once, the fine-tune switch 28 is triggered once, and the fine-tune switch generates a shooting signal to the controller 20. The controller controls the cylinder valve rod 241 to produce one back and forth movement. The trigger link rod 30 is used to drive the trigger 16 to pull once and shoot out one nail.

The sub-modes of the shooting mode is not limited to the foregoing three kinds, but modifications to each different shooting mode can be made without exceeding the principle of shooting and the scope of this invention. The three modes are only used to describe this invention, but not limited to the disclosed embodiments.

Compared with the traditional nail gun, the present invention has the following advantages:

A. The ways of controlling the nail gun includes a traditional manual control and an electronic control.

B. The user may switch between the manual control and the electronic control.

C. In the electronic control mode, the shooting mode and shooting speed can be adjusted. The user can select the appropriate mode as needed to assist the nailing job.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. An apparatus for controlling an electronic nail gun, being built on a traditional nail gun structure, said controlling apparatus comprising:

a controller for letting a user set a shooting mode;

a power supply for supplying electric power to said controller;

a three-outlet pneumatic valve for controlling the movement according to the shooting mode set by said controller;

a cylinder having a valve rod, said valve rod moving back and forth and controlled by an airflow direction set by said three-outlet pneumatic valve;

a fine-tune switch being pressed by a user to generate a shooting message to said controller to turn on said three-outlet pneumatic valve and cylinder; and a trigger link rod, having one end coupled to the valve rod of said cylinder, and the other end producing a clutch relationship with the trigger of the nail gun; thereby the trigger of the nail gun being indirectly controlled by the valve rod of said cylinder when the trigger link rod being engaged with the trigger.

2. The apparatus for controlling an electronic nail gun of claim 1, wherein said shooting mode is a single shot mode.

3. The apparatus for controlling an electronic nail gun of claim 2, wherein said shooting mode refers to the process of said fine-tune switch generating a shooting message to said controller; said controller controlling said three-outlet pneumatic valve, such that the valve rod of said cylinder producing a back and forth movement once; and said trigger link rod coupling to said trigger, such that said trigger being pulled once; and said shooting gun shooting out one nail.

4. The apparatus for controlling an electronic nail gun of claim 1, wherein said shooting mode is a successive shooting mode.

5. The apparatus for controlling an electronic nail gun of claim 4, wherein said shooting mode refers to the process of said fine-tune switch generating a plurality of successive shooting messages to said controller; said controller controlling said three-outlet pneumatic valve and the valve rod of said cylinder to produce a predetermined number of times for successive back and forth movements; and said trigger link rod coupling to said trigger, such that said trigger being pulled for a predetermined number of times; and said shooting gun shooting out a predetermined number of nails.

6. The apparatus for controlling an electronic nail gun of claim 4, wherein said shooting mode refers to the process of said fine-tune switch generating a shooting message to said controller; said controller controlling said three-outlet pneumatic valve and the valve rod of said cylinder to produce a predetermined number of times for successive back and forth movements; and said trigger link rod coupling to said trigger, such that said trigger being pulled for a predetermined number of times; and said shooting gun shooting out a predetermined number of nails.

7. The apparatus for controlling an electronic nail gun of claim 4, wherein said shooting mode has a nail shooting speed of 4~20 shots per minute.

8. The apparatus for controlling an electronic nail gun of claim 1, wherein said controller provides a counting mode.

9. The apparatus for controlling an electronic nail gun of claim 1, wherein said controller provides a timing mode.

10. The apparatus for controlling an electronic nail gun of claim 1, wherein said controller provides a power management mode.

11. The apparatus for controlling an electronic nail gun of claim 1, wherein said power supply is a battery.

12. The apparatus for controlling an electronic nail gun of claim 1, wherein said controller is disposed at one end side of a handle of the nail gun.

13. The apparatus for controlling an electronic nail gun of claim 1, wherein said three-outlet pneumatic valve having a connector coupled to said cylinder in the nail gun, and another two connectors respectively coupled to the front and rear ends of said cylinder to switch the airflow in the three outlets such that the valve rod of said cylinder producing a back and forth movement.

14. The apparatus for controlling an electronic nail gun of claim 13, wherein said trigger link rod coupled to the valve rod of said cylinder has a long hole at one end of the coupling, and a threaded section on one end of the valve rod passing through said hole and being secured by two screw nuts.

15. The apparatus for controlling an electronic nail gun of claim 1, wherein said cylinder is disposed proximate the side of said trigger of the nail gun.

16. A method for controlling an electronic nail gun, comprising the steps of:

(a) setting a shooting mode;

(b) generating a shooting signal by the control of a user;

(c) said shooting signal driving a back-and-forth mechanism to produce a back and forth movement according to said shooting mode; and (d) a trigger of the nail gun being pulled synchronously with said back and forth movement.

17. The method for controlling an electronic nail gun of claim 16, wherein said shooting mode is a single shot mode.

18. The method for controlling an electronic nail gun of claim 16, wherein said shooting mode refers to one shooting signal driving said back-and-forth movement to produce one back and forth movement.

19. The method for controlling an electronic nail gun of claim 16, wherein said shooting mode is a successive shooting mode.

20. The method for controlling an electronic nail gun of claim 19, wherein said back and forth mechanism moves back and forth at speed of 4~20 times per minute when successive shooting mode is set.

* * * * *